US006688503B2

(12) United States Patent
Viazanko et al.

(10) Patent No.: US 6,688,503 B2
(45) Date of Patent: Feb. 10, 2004

(54) ADJUSTABLE GARMENT HANGER

(76) Inventors: Thomas Viazanko, 1414 Madrigal La., The Villages, FL (US) 32159; Robert Gilling, 1470 Rivers Edge, Caro, MI (US) 48723; Thomas Kenny, 5692 Clearview Dr., Troy, MI (US) 48098

( * ) Notice: Subject to any disclaimer, the term of this patent is extended or adjusted under 35 U.S.C. 154(b) by 0 days.

(21) Appl. No.: 10/047,559

(22) Filed: Jan. 15, 2002

(65) Prior Publication Data

US 2003/0132258 A1 Jul. 17, 2003

(51) Int. Cl.[7] ..... A41D 27/22
(52) U.S. Cl. ..... 223/89; 223/94
(58) Field of Search ..... 223/85, 89, 94

(56) References Cited

U.S. PATENT DOCUMENTS

| | | | | |
|---|---|---|---|---|
| 5,074,445 A | * | 12/1991 | Chen | 223/85 |
| 5,082,152 A | | 1/1992 | Chen | 223/89 |
| 5,145,098 A | * | 9/1992 | Tung | 223/94 |
| 5,456,391 A | | 10/1995 | Chang | 223/94 |
| 5,680,972 A | | 10/1997 | Clarke | 223/88 |
| 5,934,524 A | | 8/1999 | Gray | 223/85 |
| 5,975,385 A | | 11/1999 | See | 223/94 |
| 6,062,445 A | | 5/2000 | Nakamoto | 223/94 |

* cited by examiner

*Primary Examiner*—John J. Calvert
*Assistant Examiner*—James G Smith
(74) *Attorney, Agent, or Firm*—Gifford, Krass, Groh, Sprinkle, Anderson & Citkowski, PC

(57) ABSTRACT

An adjustable garment hanger is provided which includes a body, a pair of fixed arms extending from the body, such that an upper end of each fixed arm includes a guide rail, and a mid-section of each fixed arm includes an indexing track. The adjustable garment hanger also includes a pair of telescoping arms slidingly disposed on the guide rail for each fixed arm, wherein the telescoping arm includes two side walls joined by an upper wall, and a plurality of opposed indexing arms that travel in the indexing track of the fixed arm to retain a position of the telescoping arm relative to the fixed arm. The adjustable garment hanger further includes a stop integral with the fixed arm for limiting the travel of the telescoping arm relative to the fixed arm in a fully extended position.

21 Claims, 3 Drawing Sheets

ADJUSTABLE GARMENT HANGER

BACKGROUND OF THE INVENTION

1. Field of the Invention

The present invention relates generally to a hanger and, more specifically, to a multi-functional hanger for a garment that is adjustable.

2. Description of the Related Art

Hangers are well known in the art for vertically storing a garment. A hanger typically includes a longitudinally extending body, and a hook extending radially from the body. The body supports a shoulder portion of a garment or item of clothing disposed thereon. Nonadjustable garment hangers are commercially available in only a few sizes, as measured by the length of the body. However, clothing comes in a wide variety of styles, sizes and shapes to accommodate the myriad of shapes and sizes of the population. For example, a hanger intended for child-sized clothing will inadequately support adult clothing, and likewise a hanger intended for adult clothing will inadequately support child-sized clothing. As a result of using the wrong sized hanger, the clothing tends to develop unwanted wrinkles, puckers, hanger marks or the like in a shoulder portion or a sleeve portion.

Hangers with adjustable body lengths are known in the art to accommodate various sized clothing. One example of an adjustable hanger includes a tubular body with outwardly extending fixed arms, and a telescoping arm having a U-shape slidingly disposed on the fixed arm, for modifying the length of the body portion. While this type of hanger works in extending the length of the body, it suffers from several shortfalls. First of all, it is difficult to extend both of the telescoping arms an even distance. Also, the telescoping arm can be pulled off the fixed arm while adjusting the length. In addition, the telescoping arms flex when extended outwardly and supporting the weight of an article of clothing.

Thus, there is a need in the art for a multifunctional hanger with a telescoping arm to adjust the overall length of the hanger to accommodate a variety of clothing shapes and styles.

SUMMARY OF THE INVENTION

Accordingly, the present invention is an adjustable garment hanger which includes a body, and a pair of fixed arms extending from the body, such that an upper end of each fixed arm includes a guide rail, and a mid-section of each fixed arm includes an indexing track. The adjustable garment hanger also includes a pair of telescoping arms slidingly disposed on the guide rail for each fixed arm, wherein the telescoping arm includes two side walls joined by an upper wall, and a plurality of opposed indexing arms that travel in the indexing track of the fixed arm to retain a position of the telescoping arm relative to the fixed arm. The adjustable garment hanger further includes a stop integral with the fixed arm for limiting the travel of the telescoping arm relative to the fixed arm in a fully extended position.

One advantage of the present invention is that an adjustable garment hanger is provided that is multifunctional. Another advantage of the present invention is that the adjustable garment hanger includes a telescoping arm that is incrementally positioned to accommodate various sized clothing. Still another advantage of the present invention is that the adjustable garment hanger holds multiple clothing items and includes a belt hook, a slot for an article of clothing such as a tie or scarf, and hooks for straps or loops. A further advantage of the present invention is that the adjustable garment hanger is easily adjusted to accommodate various types and sizes of clothing, so that the clothing hangs neatly from the hanger without puckering, slipping, wrinkling or the like.

Other features and advantages of the present invention will be readily appreciated, as the same becomes better understood after reading the subsequent description taken in conjunction with the accompanying drawings.

BRIEF DESCRIPTION OF THE DRAWINGS

FIG. 2 is a perspective view of the adjustable garment hanger of FIG. 1 with the telescoping arms in an adjusted position, according to the present invention.

DESCRIPTION OF THE PREFERRED EMBODIMENT(S)

Figure 1:
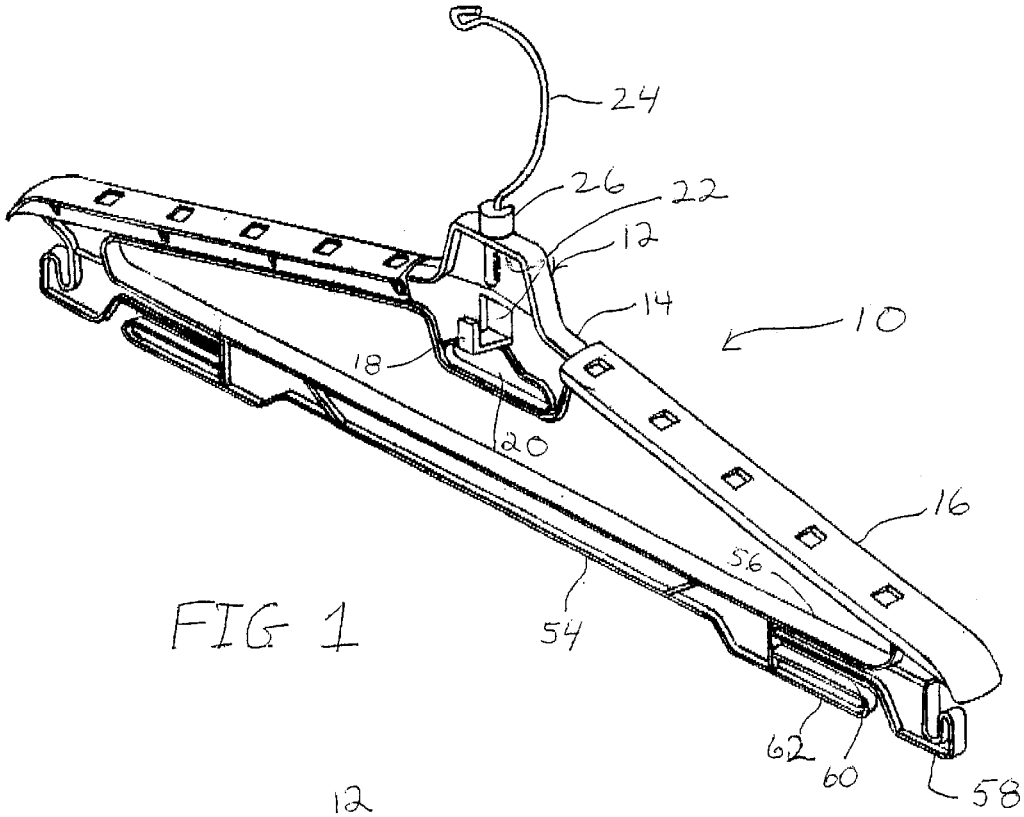
FIG. 1 is a perspective view of an adjustable garment hanger, according to the present invention.
Figure 3:
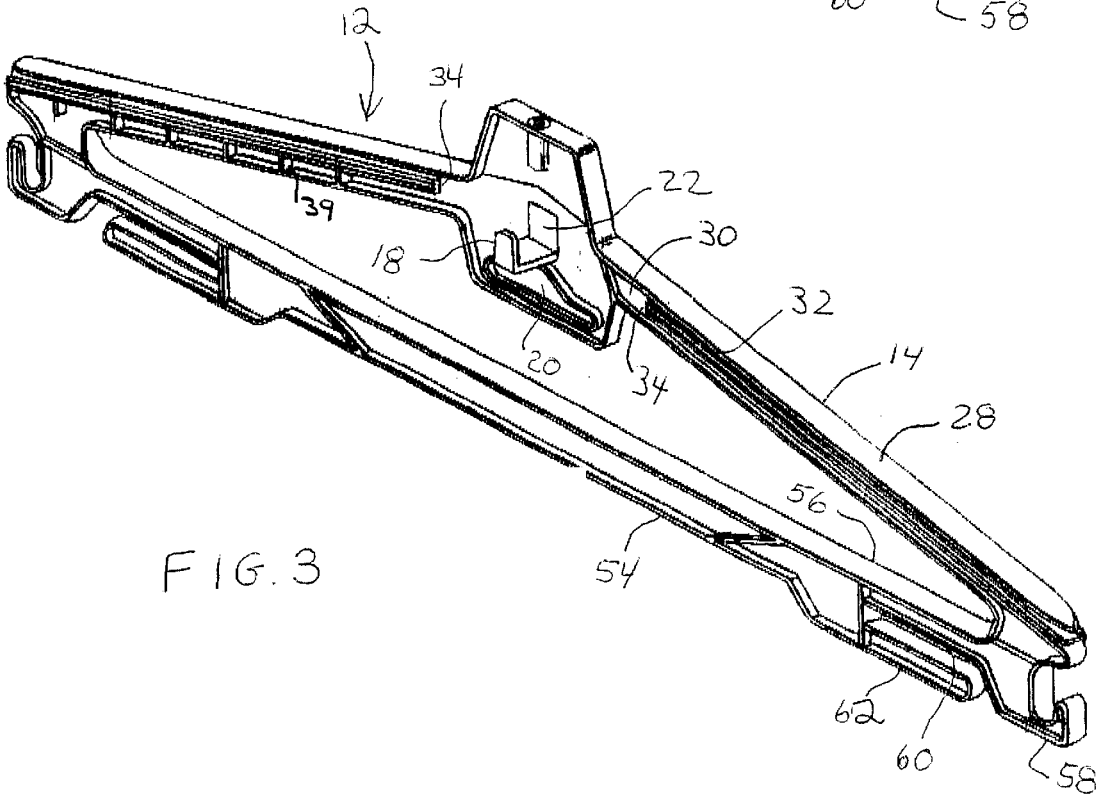
FIG. 3 is a perspective view of the body for the adjustable garment hanger of FIG. 1, according to the present invention.
Figure 7:
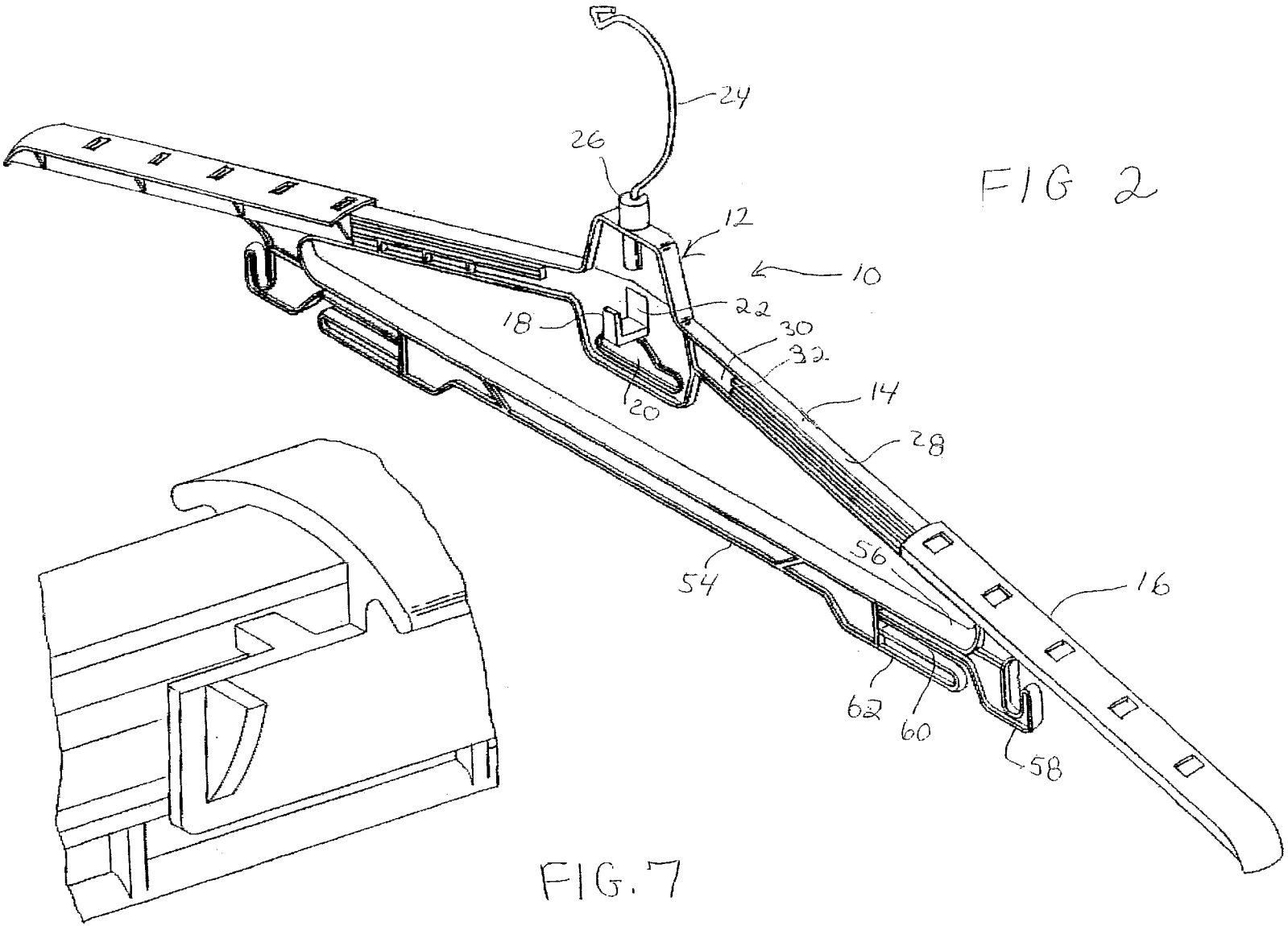
FIG. 7 is a partially cutaway sectional view illustrating the travel of the telescoping arm limited by the stop in the fixed for the adjustable garment hanger of FIG. 2, according to the present invention.
Figure 4:
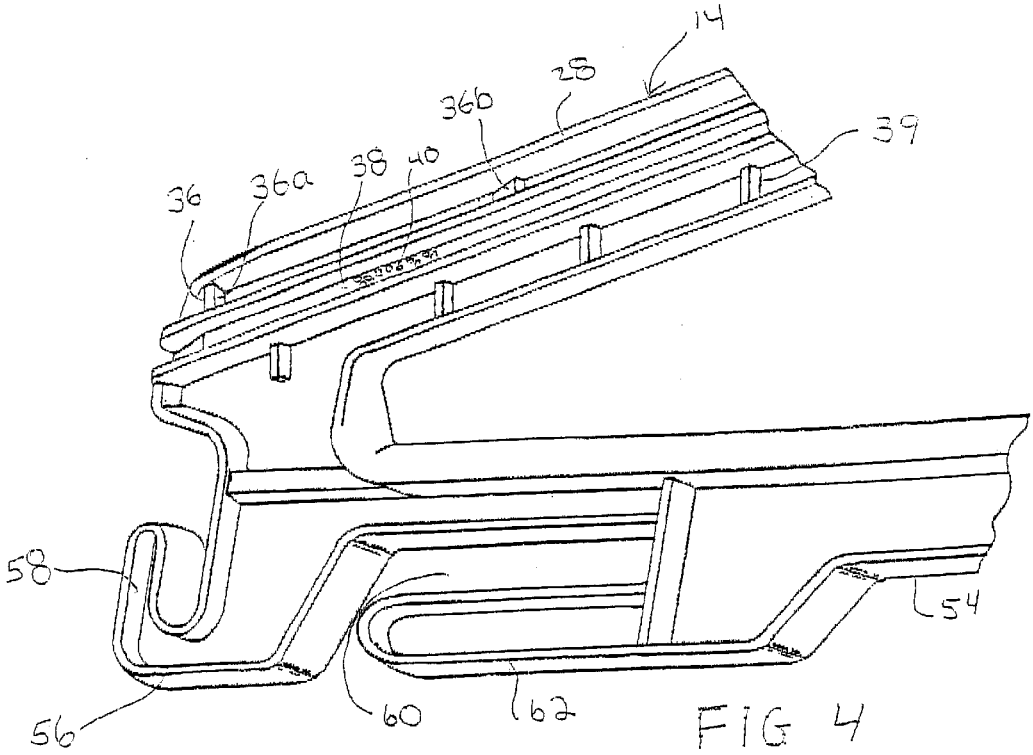
FIG. 4 is an enlarged view of an end of the body of the adjustable garment hanger of FIG. 3, according to the present invention.
Figure 5:
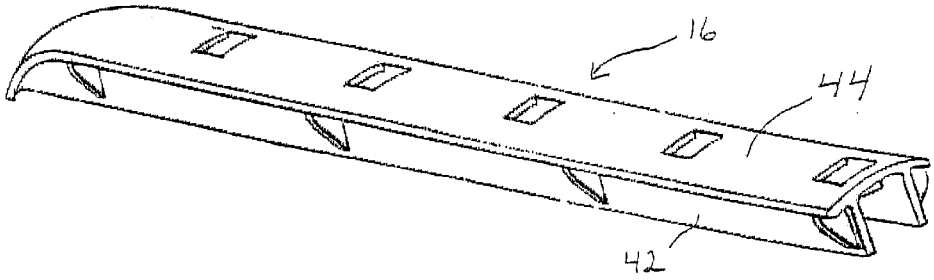
FIG. 5 is a perspective top view of the telescoping arm for the adjustable garment hanger of FIG. 1, according to the present invention.
Figure 6:
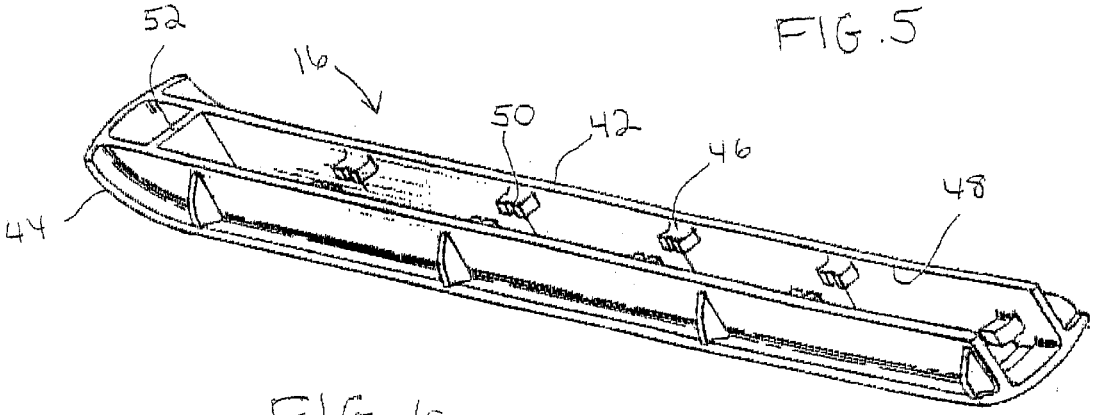
FIG. 6 is a perspective bottom view of the telescoping arm for the adjustable garment hanger of FIG. 1, according to the present invention.

Referring to FIGS. 1–7 an adjustable garment hanger 10 is illustrated. The garment hanger 10 is utilized to support articles of clothing (not shown), such as coats, jackets, shirts, blouses or the like. In this example, the overall length of the adjustable garment hanger 10 varies from seventeen inches to twenty-seven inches, to advantageously accommodate various clothing dimensions. The adjustable garment hanger 10 includes a body 12, a pair of longitudinally extending fixed arms 14 extending from the body 12, and a telescoping arm 16 slidingly disposed on each fixed arm 14. It should be appreciated that the fixed arms 14 extend at an inclined angle from the body 12 to further accommodate the shape of the shoulder portion of clothing.

The body 12 includes a radially extending hook member 18. Preferably the hook member has a backwards "L" shape. Advantageously, the hook 18 provides for storage of a belt or the like. The body 12 also includes a longitudinally extending slot 20. In this example, the longitudinally extending storage slot 20 is positioned below the hook member 18. Advantageously, the storage slot 20 provides for storage of a clothing item, such as a tie or scarf. The body 12 further includes a centrally located aperture 22, preferably having a square shape, that provides a user (not shown) with easier access to an item of clothing stored on the hook 18 or in the storage slot 20.

The body 12 includes a hanger hook 24 extending upwardly from an upper end of the body 12, for hanging the hanger 10 for storage or display purposes. For example, the hanger 10 may be hung on a closet rod (not shown), or a display rack (not shown). The hanger hook 24 has a generally "C" shape. It should be appreciated that the hanger hook 24 may be integral with the body 12, or a separate member attached to the body 12. It should also be appreciated that the hanger hook 24 may be stationary, or may swivel. Advantageously, the swivel hanger hook 24 increases the flexibility of how the adjustable garment hanger 10 is used. This is particularly beneficial for a visual display in a retail environment. In addition, a garment size identification marker 26, as is known in the art, may be secured on the hanger hook 24.

The telescoping arm 16 is slidingly disposed over the fixed arm 14. The fixed arm 14 generally has an I-shape in cross-section. An upper end of the fixed arm includes a radially extending guide rail 28 that the telescoping arm 16 fits over, in a manner to be described. A mid-section 30 of the fixed arm 14 includes a pair of parallel ribs 32, extending radially from the mid-section 30 of the fixed arm 14 and longitudinally therealong, to form an indexing track for the telescoping arm 16. An end wall 34 extends therebetween an upper end of each of the parallel ribs. It should be appreciated that the end wall 34 can provide an upper stop for use in positioning the telescoping arm 16 in a retracted position.

The fixed arm 14 also includes at least one, and preferably two lower stops 36 for retaining the telescoping arm 16 on the fixed arm 14. A first lower stop 36*a* is positioned at an end of the fixed arm 14, and adjacent the guide rail 28. A second lower stop 36*b* is positioned a predetermined distance inwards of the first lower stop 36*a*. Preferably, the lower stops 36*a*, 36*b* extend radially from the fixed arm 14, and generally have a wedge shape. Advantageously, this shape provides for ease of assembly of the telescoping arm 16 onto the fixed arm 14, and retention of the telescoping arm 16 on the fixed arm 14 after assembly.

The mid-section 30 of the fixed arm 14 also includes an indexing surface 38 extending therebetween the parallel ribs 32, for indexing the position of the telescoping arm 16 relative to the fixed arm 14. In this example, the indexing surface 38 includes a plurality of raised members 40 extending radially from the fixed arm 14. Also, in this example, the raised members 40 have a cylindrical shape, although other shapes are contemplated, such as rectangular or triangular. Another example of an indexing surface (not shown) includes a plurality of vertically extending grooves spaced a predetermined distance apart. The fixed arm 14 further includes an indexing mark 39, which in this example is a plurality of ribs spaced a predetermined distance apart. The indexing marks 39 are used to evenly position each telescoping arm 16 with respect to each fixed arm 14.

The telescoping arm 16 includes two parallel side walls 42, and an upper wall 44 joining the side walls 42 to form a generally U-shaped member. It should be appreciated that the width of the upper wall 44 is advantageously determined to provide adequate support of the shoulder portion of the clothing hung on the adjustable hanger. The telescoping arm 16 also includes a plurality of opposed indexing arms 46 extending radially from an inner surface 48 of each side wall 42. In this example, the indexing arm 46 is a generally planar member having a vertical orientation, with a notch 50 located in the center of the arm. Advantageously, the notch 50 in the indexing arm 46 assists in providing an inference fit between the indexing arm 46 and the raised member 40. In this example, there are five pairs of opposed indexing arms 46. The telescoping arm 16 further includes an end wall 52 positioned between an outer end of the parallel side walls 42. The end wall 52 limits the travel of the telescoping arm 16 in a retracted direction.

In operation, the position of the telescoping arm 16 is adjusted relative to the fixed arm 14 by sliding the telescoping arm 16. The upper wall 44 of the telescoping arm 16 slides along the guide rail 28 in the fixed arm 14, and the indexing arm 46 of the telescoping arm 16 travels through the indexing track 32 of the fixed arm 14. The desired position of the telescoping arm 16 relative to the fixed arm 14 is maintained by an interference fit between the indexing arm 46 and the indexing surface 38. It should be appreciated that the end wall 52 and lower stops 36*a*, 36*b* limit the travel of the telescoping arm 16 relative to the fixed arm 14 in retracted and extended positions respectively. In addition, the lower stop 36*a*, 36*b* prevents the telescoping arm 16 from sliding off the fixed arm 14.

The body 12 further includes a cross-member 54 extending therebetween an outer end of the fixed arm. In this example, the cross-member 54 generally has a cross-sectional "I"-shape. Advantageously, the cross-member 54 provides a storage surface for an article of clothing such as pants. In this example, an outer end 56 of the cross-member has a backwards "J" shape, to form a vertically extending hook 58. Advantageously, an article of clothing with a hanging loop, or thin strap, can be securely hung on the hanger 10 using the hook 58. Also in this example, a pair of slots 60 are formed in the cross-member 54, with one end open, to form a longitudinally extending hook 62. Advantageously, an article of clothing with a hanging loop, or thin strap, can also be securely hung on the hanger 10 using the longitudinally extending hook 62.

It should be appreciated that the adjustable garment hanger 10 may include other attaching mechanisms, such as clips (not shown) or bars (not shown) or the like, that are known in the art for securing at article of clothing to a hanger. Preferably, the body 12, fixed arm 14, and cross-member 54 are integral and formed as one piece. The hanger 10 of the present invention may be fabricated from a number of materials, including metals, polymers, composites, wood or the like. In some preferred embodiments, the hanger hook 24 will be integral with the body 12, in others the hanger hook 24 is a separate piece fabricated from another material, such as metal.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An adjustable garment hanger comprising:

a body, wherein said body includes a cross-member extending therebetween an outer end of each of said fixed arms, and an outer end of said cross-member includes a vertically extending hook forming a backwards "J" shape;

a pair of fixed arms extending from said body, wherein an upper end of each fixed arm includes a guide rail, and a mid-section of each fixed arm includes an indexing track;

a pair of telescoping arms slidingly disposed on said guide rail for each of said fixed arms, wherein said telescoping arm includes two side walls joined by an upper wall, and a plurality of opposed indexing arms extending radially from an inner surface of each side wall, such that said indexing arms travel in said indexing track of said fixed arm to retain a position of said telescoping arm relative to said fixed arm; and a stop integral with said fixed arm for limiting the travel of said telescoping arm relative to said fixed arm in a fully extended position.

2. A hanger as set forth in claim 1 wherein said cross-member includes a pair of longitudinally extending hooks.

3. A hanger as set forth in claim 1 wherein said body includes a longitudinally extending storage slot.

4. A hanger as set forth in claim 1 wherein said body includes a radially extending hook member having a backwards "L" shape.

5. A hanger as set forth in claim 1, further comprising a hanger hook extending from an upper end of said body.

6. A hanger as set forth in claim 1 wherein said fixed arm has an I-shape in cross-section.

7. A hanger as set forth in claim 1 wherein said indexing track includes a pair of parallel ribs extending radially from a midsection of the fixed arm and longitudinally therealong.

8. A hanger as set forth in claim 7 wherein said indexing track also includes an indexing surface between said parallel ribs, and said indexing surface includes a plurality of radially extending raised members.

9. A hanger as set forth in claim 8 wherein said raised members are cylindrical in shape.

10. A hanger as set forth in claim 8 wherein said raised members are a plurality of vertically extending grooves spaced a predetermined distance apart.

11. A hanger as set forth in claim 1 wherein said telescoping arm includes an end wall located between an outer end of said side walls, to limit the travel of said telescoping arm relative to said fixed arm in a retracted position.

12. An adjustable garment hanger comprising:

a body;

a pair of fixed arms extending from said body, wherein said fixed arm has an I-shape in cross-section and an upper end of each fixed arm includes a guide rail;

an indexing track formed on a midsection of said fixed arm, wherein said indexing track includes a pair of parallel ribs extending longitudinally therealong;

an indexing surface between said parallel ribs, wherein said indexing surface includes a plurality of radially projecting raised members;

a pair of telescoping arms slidingly disposed on said guide rail for each of said fixed arms, wherein said telescoping arm includes two side walls joined by an upper wall, and a plurality of opposed indexing arms extending radially from an inner surface of each side wall, such that said indexing arms travel in said indexing track of said fixed arm, and a position of said telescoping arm relative to said fixed arm is maintained by the retention of the indexing arm by the indexing surface;

an end wall located at an outer end of said side walls of said telescoping arm, to limit the travel of said telescoping arm relative to said fixed arm in a retracted position;

a stop integral with said fixed arm for limiting the travel of said telescoping arm relative to said telescoping arm in a fully extended position; and a cross-member extending therebetween an outer end of each of said fixed arms, wherein said cross-member has a cross-sectional "I" shape, and an outer end of said cross-member includes a vertically extending hook forming a backwards "J" shape.

13. A hanger as set forth in claim 12 where in said cross-member includes a pair of longitudinally extending hooks.

14. A hanger as set forth in claim 12 wherein said body includes a longitudinally extending storage slot.

15. A hanger as set forth in claim 12 wherein said body includes a radially extending hook member having a backwards "L" shape.

16. A hanger as set forth in claim 12, further comprising a hanger hook extending from an upper end of said body.

17. A hanger as set forth in claim 12 wherein said raised members are cylindrical in shape.

18. A hanger as set forth in claim 12 wherein said raised members are a plurality of vertically extending grooves spaced a predetermined distance apart.

19. An adjustable garment hanger comprising:

a body, wherein said body includes a longitudinally extending storage slot and a radially extending hook member having a backwards "L" shape;

a hanger hook extending from an upper end of said body;

a pair of fixed arms extending from said body, wherein each of said fixed arms has an I-shape in cross-section, and an upper end of each fixed arm includes a guide rail;

an indexing track formed on a midsection of said fixed arm, wherein said indexing track includes a pair of parallel ribs extending longitudinally therealong;

an indexing surface between said parallel ribs, wherein said indexing surface includes a plurality of radially projecting raised members;

a pair of telescoping arms slidingly disposed on said guide rail for each of said fixed arms, wherein said telescoping arm includes two side walls joined by an upper wall;

a plurality of opposed indexing arms extending radially from an inner surface of each side wall wherein said indexing arm includes a notch, such that said indexing arms travel in said indexing track of said fixed arm and a position of said telescoping arm relative to said fixed arm is maintained by the retention of the notch in the indexing arm by the indexing surface;

an end wall located at an outer end of said side walls of said telescoping arm, to limit the travel of said telescoping arm relative to said fixed arm in a retracted position;

a stop integral with said fixed arm for limiting the travel of said telescoping arm relative to said fixed arm in a fully extended position; and a cross-member extending therebetween an outer end of each of said fixed arms, wherein said cross-member has a cross-sectional "I" shape, an outer end of said cross-member includes a vertically extending hook forming a backwards "J" shape, and said cross-member includes a pair of longitudinally extending hooks.

20. A hanger as set forth in claim 19 wherein said raised members are cylindrical in shape.

21. A hanger as set forth in claim 19 wherein said raised members are a plurality of vertically extending grooves spaced a predetermined distance apart.

* * * * *

UNITED STATES PATENT AND TRADEMARK OFFICE

CERTIFICATE OF CORRECTION

PATENT NO. : 6,688,503 B2 
DATED : February 10, 2004
INVENTOR(S) : Thomas Viazanko, Robert Gilling and Thomas Kenney It is certified that error appears in the above-identified patent and that said Letters Patent is hereby corrected as shown below:

Column 4,
Line 54, after "Cross-member", insert -- having a cross-sectional "I" shape and --

Signed and Sealed this

First Day of February, 2005

JON W. DUDAS
*Director of the United States Patent and Trademark Office*